United States Patent [19]

Booker

[11] Patent Number: 4,504,578

[45] Date of Patent: Mar. 12, 1985

[54] IN SITU FILM HARDENING WITH PYRIDINE-N-OXIDE AND ALDEHYDE PRECURSOR

[75] Inventor: Reginald A. Booker, New Castle, Del.

[73] Assignee: E. I. Du Pont de Nemours and Company, Wilmington, Del.

[21] Appl. No.: 540,775

[22] Filed: Oct. 11, 1983

[51] Int. Cl.[3] ..... G03C 1/30

[52] U.S. Cl. ..... 430/621; 430/523; 260/117

[58] Field of Search ..... 430/621, 523; 260/117

[56] References Cited

U.S. PATENT DOCUMENTS 3,770,451 11/1973 Jenkins et al. ..... 260/117

*Primary Examiner*—Won H. Louie

[57] ABSTRACT

A hardened photographic film is formed as a result of in situ generation of aldehyde hardener, by incorporating an aldehyde precursor in one layer and pyridine-N-oxide in an adjacent layer. Preferred aldehyde precursor is 1,5-dibromopentane or 1,5-dichloropentane.

5 Claims, No Drawings

IN SITU FILM HARDENING WITH PYRIDINE-N-OXIDE AND ALDEHYDE PRECURSOR

BACKGROUND OF THE INVENTION

1. Field of the Invention

The present invention relates to hardening gelatin layers in photographic silver halide films.

2. Description of the Prior Art

Photographic films are commonly formed by coating two or more layers on a support. The layers comprise a wide range of aqueous dispersions of both light-sensitive and auxiliary compositions. Many films comprise two layers wherein a silver halide emulsion is coated on the support and is then overcoated with a protective or antiabrasion layer.

A wide variety of agents are known for hardening gelatin layers in photographic silver halide films, e.g., Chrome alum, formaldehyde, glutaraldehyde, glyoxal and 1,3,5-triacryloyl-hexahydro-S-triazone. Abele et al, U.S. Pat. No. 4,124,397, describes a process in which glutaraldehyde and its derivatives are injected into a photographic emulsion to avoid adverse effects on sensitivity and premature hardening; while Le Strange, U.S. Pat. No. 4,175,970, describes sensitization of a silver halide emulsion with a combination of glutaraldehyde and an aromatic sulfonic acid.

Glutaraldehyde is known to crosslink gelatin as much as 3600 times as fast as formaldehyde. Because of this rapid hardening action glutaraldehyde serves an important role as a hardener in developers. When it is used in a developer the sensitization and premature hardening problems associated with incorporation of glutaraldehyde in a sensitive silver halide emulsion do not occur.

It would be a significant advance to be able to employ a hardener such as glutaraldehyde directly within a silver halide emulsion and obtain rapid hardening without the drawbacks of special equipment and procedures.

SUMMARY OF THE INVENTION

Hardening of a photographic film according to the present invention involves incorporation of pyridine-N-oxide in one coating composition and an aldehyde precursor in another composition which will be coated adjacently, followed by drying. The coated layers produce the aldehyde via component diffusion and the in situ produced aldehyde reacts with the gelatin to harden the film.

A preferred system for the practice of the present invention contains 0.1 to 1.0 mole of pyridine-N-oxide in one layer and 0.05 to 0.5 mole of 1,5-dichloropentane or 1,5-dibromopentane in another layer, per 100 g of gelatin.

DETAILED DESCRIPTION OF THE INVENTION

In situ formation of glutaraldehyde can be represented by the following equations.

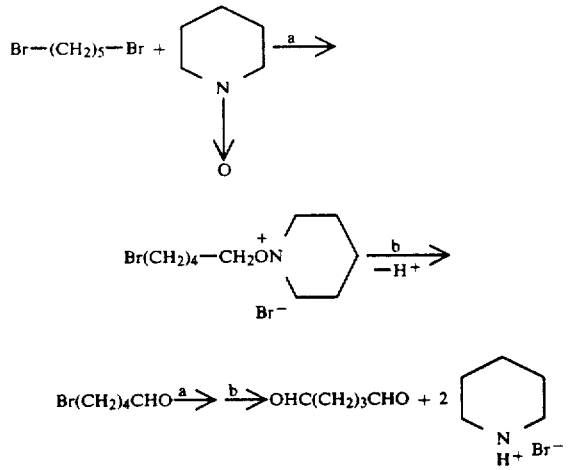

Production of formaldehyde in an in situ reaction can be represented by the simple reactions.

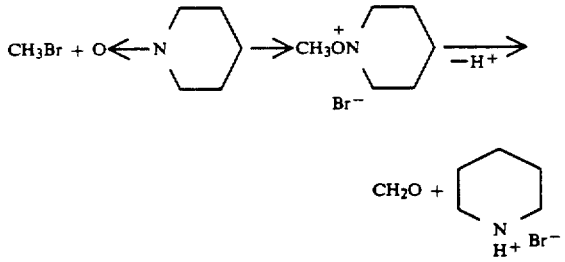

Suitable aldehyde precursors have the formula $CH_3$—X or X—R—X where R may comprise 2 to 6 carbon atoms and X may be Br, Cl, I, p-toluenesulfonate or other equivalent group. In particular, the aldehyde precursor may be 1,5-dibromopentane, 1,5 dichloropentane, methyl bromide, or methyl chloride.

Since 1 mole of an aldehyde precursor of the formula $CH_3$—X will react with 1 mole of pyridine-N-oxide to yield the aldehyde, and 1 mole of an aldehyde precursor of the formula X—R—X will react with 2 moles of pyridine-N-oxide to yield the aldehyde, it follows that any large imbalance of additions in the two layers would serve no useful purpose because the excess could not react to produce hardener in the film. Useful amounts of either the pyridine-N-oxide or the aldehyde precursor may be between 0.01 and 2.0 mole per 100 g of gelatin in the layer to which they are added. Preferred amounts range from 0.05 to 1.0 mole of reactant per 100 g of gelatin in the layer for obtaining the degree of hardening usually required by commercial films.

Compounds of the present invention can be added to a wide range of coated layers to in situ harden an aldehyde-crosslinkable protective colloid or binder. These include not only emulsion and antiabrasion layers but also underlayers, anticurl backings, release layers, and mottle layers. In a three-layer coating it would be possible to put one reactant in the middle composition and distribute the other reactant in both the top and bottom layer. In a multiple layer coating the compounds could be alternated from layer to layer to provide maximum diffusion and reaction throughout the coated film.

The following examples serve to illustrate the invention.

EXAMPLE 1

A silver iodobromide emulsion was prepared and gold- and sulfur-sensitized according to known techniques in the art. After final additions were made the emulsion was divided for coating as a control without further additions and for experimental coatings per the present invention.

A gelatin solution was prepared for overcoating the emulsion. This was also split into portions. One portion which served as a control received an addition of 0.185 mole of formaldehyde per 100 g of gelatin in the overcoat composition.

For the control film the emulsion with no addition was coated on a polyethyleneterephthalate support and overcoated with the control overcoat containing formaldehyde.

Based on 100 g of gelatin in the emulsion the following additions of pyridine-N-oxide were made to three portions of emulsion: Emulsion 1, 0.1 mole; emulsion 2, 0.2 mole; emulsion 3, 0.3 mole.

To portions of overcoat containing 100 g of gelatin the following additions of 1,5-dichloropentane were made; Overcoat 1, 0.08 mole; overcoat 2, 0.08 mole; overcoat 3, 0.16 mole.

Each emulsion was then overcoated with its corresponding overcoat to provide films demonstrating the in situ hardening according to the present invention.

After drying, the films were cut into samples for sensitometric and physical tests to determine hardening.

Melting points were determined by marking film strips with a black mark made with coater permanent brand marker and placing the strips in a 10% sodium hydroxide solution and raising the solution temperatures until the black mark was observed to disappear. Wet gouge susceptibilities were determined by placing an increasing weight load on a sapphire stylus point as it is drawn across a film immersed in developer. A melting point below 35° C. and a wet gouge force of 0 indicate that the gelatin has not been hardened. The maximum reading for the wet gouge force was 124 grams.

Table 1 contains comparative data obtained after the films had aged for one month.

TABLE 1

| FILM | MELTING POINT | WET GOUGE FORCE | SPEED | D MAX | FOG |
|---|---|---|---|---|---|
| Control | 53° C. | 124.0 | 813 | 2.84 | .04 |
| 1 | 56° C. | 20.3 | 879 | 2.06 | .04 |
| 2 | 51° C. | 10.3 | 828 | 2.73 | .04 |
| 3 | 52° C. | 9.0 | 854 | 2.49 | .04 |

These results clearly show hardening in all three films without adversly affecting sensitometry.

EXAMPLE 2

When dibromopentane was substituted for dichloropentane in the two-part hardening system of Example 1 similar hardening was observed in comparison to a control hardened with formaldehyde. After one day the reaction of 0.16 mole pyridine-N-oxide with 0.08 mole dichloropentane provided 75% of the hardening of the formaldehyde control. When measured at one month the two were nearly equal in hardening levels. At two months age the coatings made with two-part hardening gave a maximum wet gouge reading of 124, and were equivalent to the formaldehyde control. It is believed that dibromopentane reacts faster than dichloropentane under similar conditions because the chlorine is more tightly bound than the bromine.

EXAMPLE 3

The reactions of dibromopentane and dichloropentane with pyridine-N-oxide were studied in a 3-7% gelatin solution at 35° C. using viscosity measurements. However, these two systems showed very little effect on viscosity of the aqueous gelatin in comparison to a control containing formaldehyde which effectively gelled the solution within about three hours of adding the formaldehyde. Thus, while Examples 1 and 2 show that the two-part hardening is effective in a coated film structure, the correlation with the hardening effect of formaldehyde was not predictable from a study of solution viscosity.

EXAMPLE 4

Coatings similar to Examples 1 and 2 show an insignificant increase in hardening when pyridine-N-oxide was increased to 0.4 mole per 100 g of gelatin. This indicates that a molar imbalance of the reactive components for the two-part hardening of the present invention does not serve a useful purpose. Thus, the experimental results support the theoretical ratio of 2 moles of pyridine-N-oxide reacting with 1 mole of dihalopentane.

EXAMPLE 5

When dibromobutane was substituted for dibromopentane as in Example 2 the degree of hardening obtained was significant, but less effective than either dibromopentane or dichloropentane as in Example 1. This clearly indicates that other aldehyde precursors can react with pyridine-N-oxide within the scope of the present invention to provide a useful two-part hardening system.

I claim:

1. A process of forming a hardened photographic film in which a layer comprised of silver halide dispersed in gelatin is coated on a support in contact with another layer and dried to form the film, characterized in that an aldehyde hardening agent is formed in situ by reacting an aldehyde precursor in one layer and a pyridine-N-oxide in an adjacent layer.

2. The process of claim 1 wherein one reactant is in the silver halide emulsion layer and the other in an adjacent layer.

3. The process of claim 1 where the aldehyde precursor has the formula $CH_3$—X or X—R—X where R may comprise 2 to 6 carbon atoms and X may be Br, Cl, I, or p-toluenesulfonate.

4. The process of claim 1 where the aldehyde precursor is 1,5-dibromopentane, or 1,5-dichloropentane.

5. The process of claim 1 where the aldehyde precursor is methyl bromide.

* * * * *